United States Patent [19]

Smith et al.

[11] 4,241,673

[45] Dec. 30, 1980

[54] DIRECT IGNITION OF PULVERIZED COAL

[75] Inventors: Donald A. Smith, Haddam; Martin E. Smirlock, East Granby, both of Conn.

[73] Assignee: Combustion Engineering, Inc., Windsor, Conn.

[21] Appl. No.: 91,534

[22] Filed: Nov. 5, 1979

Related U.S. Application Data

[63] Continuation of Ser. No. 865,747, Dec. 29, 1977, abandoned, which is a continuation-in-part of Ser. No. 769,995, Feb. 18, 1977, abandoned.

[51] Int. Cl.[3] ..... F23D 1/00

[52] U.S. Cl. ..... 110/347; 110/264; 110/265; 431/2; 431/264

[58] Field of Search ..... 110/347, 263, 265, 264, 110/188, 261, 348; 431/2, 6, 263, 264, 265, 9

[56] References Cited

U.S. PATENT DOCUMENTS

| | | | |
|---|---|---|---|
| 2,806,518 | 9/1957 | Poole et al. | 431/264 X |
| 2,921,239 | 1/1960 | Dryden | 431/263 X |
| 3,007,084 | 10/1961 | Thomasian et al. | 431/266 |
| 3,250,236 | 5/1966 | Zelinski | 110/265 |
| 3,482,534 | 12/1969 | Whitman | 110/265 |
| 4,089,628 | 5/1978 | Blackburn | 110/347 X |

*Primary Examiner*—Edward G. Favors

*Attorney, Agent, or Firm*—Fishman and Van Kirk

[57] ABSTRACT

Pulverized coal is ignited, to furnish energy for warm-up or low load operation of a coal burning furnace, by a technique which does not require the combustion of significant quantities of liquid or gaseous fuels. The direct ignition of pulverized coal in accordance with the present invention contemplates the delivery of a dense phase coal/air stream to an ignition zone where it receives ignition energy and the thus ignited mixture is thereafter contained in a recirculation region until the flame becomes self-sustaining.

20 Claims, 5 Drawing Figures

DIRECT IGNITION OF PULVERIZED COAL

CROSS-REFERENCE TO RELATED APPLICATIONS

This is a continuation of application Ser. No. 865,747, filed Dec. 29, 1977, now abandoned, which is in turn a continuation-in-part of application 769,995, filed Feb. 18, 1977, now abandoned.

BACKGROUND OF THE INVENTION (1) Field of the Invention

The present invention relates to burners designed for the combustion of pulverized coal and particularly to such burners as may be utilized in coal-fired boilers of steam generators. More specifically, this invention is directed to a method for igniting pulverized coal in the absence of a substantial energy input derived from the combustion of a liquid or gaseous fuel. Accordingly, the general objects of the present invention are to provide novel and improved apparatus and methods of such character.

(2) Description of the Prior Art

Because of cost and availability, it is becoming increasingly desirable to utilize coal rather than natural gas or oil in electricity generating facilities. However, present day coal-fired steam generator boilers of the types employed by electric utilities nevertheless require substantial quantities of natural gas or oil. Restated, in order to insure safe and efficient operation, present coal-fired steam generators use premium liquid and gaseous fuels to provide both ignition and low-load flame-stabilizing energy. The required amount of these auxiliary premium fuels is significant. For example, the use of 70,000 gallons of oil in a 500 megawatt unit for one start-up is not uncommon. Accordingly, a need exists for a means of reducing the amount of auxiliary fuels needed in pulverized-coal boilers.

SUMMARY OF THE INVENTION

The present invention overcomes the above-discussed and other deficiencies and disadvantages of the prior art by providing for the direct ignition of a stream of pulverized coal and air supplied to a burner. In accordance with the invention, air and pulverized coal are introduced into a combustion chamber in the form of a stream wherein the transport air-to-coal weight ratio is less than 1.0 and preferably less than 0.5. A source of sufficient energy to heat the reactants to ignition temperature is operated in the coal-air mixture whereby the mixture is ignited. The ignition energy source may, for example, be an electric spark ignitor. The ignited mixture is contained within a recirculation region, whereby the hot combustion products are recirculated back towards the coal/air injection point, to thereby concentrate the thermal energy being released and create a self-sustaining flame. The recirculation is caused by a stream of "secondary" air. In the interest of insuring ignition, in addition to exercising control over the air-to-coal weight ratio upstream of the combustion chamber, the velocity of the coal/air mixture will be varied in accordance with the volatiles content and grind of the coal; the coal/air mixture injection velocity being in the less than 150 ft/sec. and preferably in the range of 60–75 ft/sec. In some cases, the initiation of the secondary air flow which causes the recirculation of the hot combustion products back to the coal/air injection point will be delayed; this being particularly true in the case high energy arc ignition. Further in accordance with the invention, the secondary air contribute as little as 15% of the stoichiometric combustion air.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

The apparatus shown in the accompanying drawing constitutes a representative means for accomplishing the direct ignition of a stream of pulverized coal and air in accordance with the invention and without any significant consumption of petroleum or natural gas. The present invention relies on having a dense phase coal-/air mixture wherein the transport-air stream-to-coal weight ratio, measured in a delivery conduit upstream of a combustion zone is 1.0 or less. The ignition energy source is positioned so as to be either in or insertable in the flowing air/coal stream in the combustion zone. The energy delivered to the air/coal mixture by the ignition energy source ignites the coal particles. Considering the case where the ignition energy source comprises a high energy electric arc, the ignitor thus being operated in a pulsed mode, a series of flame pockets are created.

The technique of the present invention also contemplates the establishment of secondary air flow to the combustion zone through burner secondary-air registers. The burner secondary-air registers are designed, in a manner known in the art, so as to establish a region of recirculating air and combustion products (hot gases) whereby the pockets of burning coal are recirculated back toward the point of initial coal injection and the energy in the recirculation region will increase until the flame becomes self-sustaining.

The technique of the present invention has been successfully practiced employing a high energy electric arc as the ignition energy source. However, the ignition energy source may also be a resistance heater or heaters or a hydrocarbon fueled pilot torch with minimal energy consumption. In a preferred embodiment, the ignitor will be removed from the flame region once the existence of flame has been verified. When a high energy arc supplies the ignition energy, secondary air flow will be delayed until the existence of flame has been verified.

Figure 1:
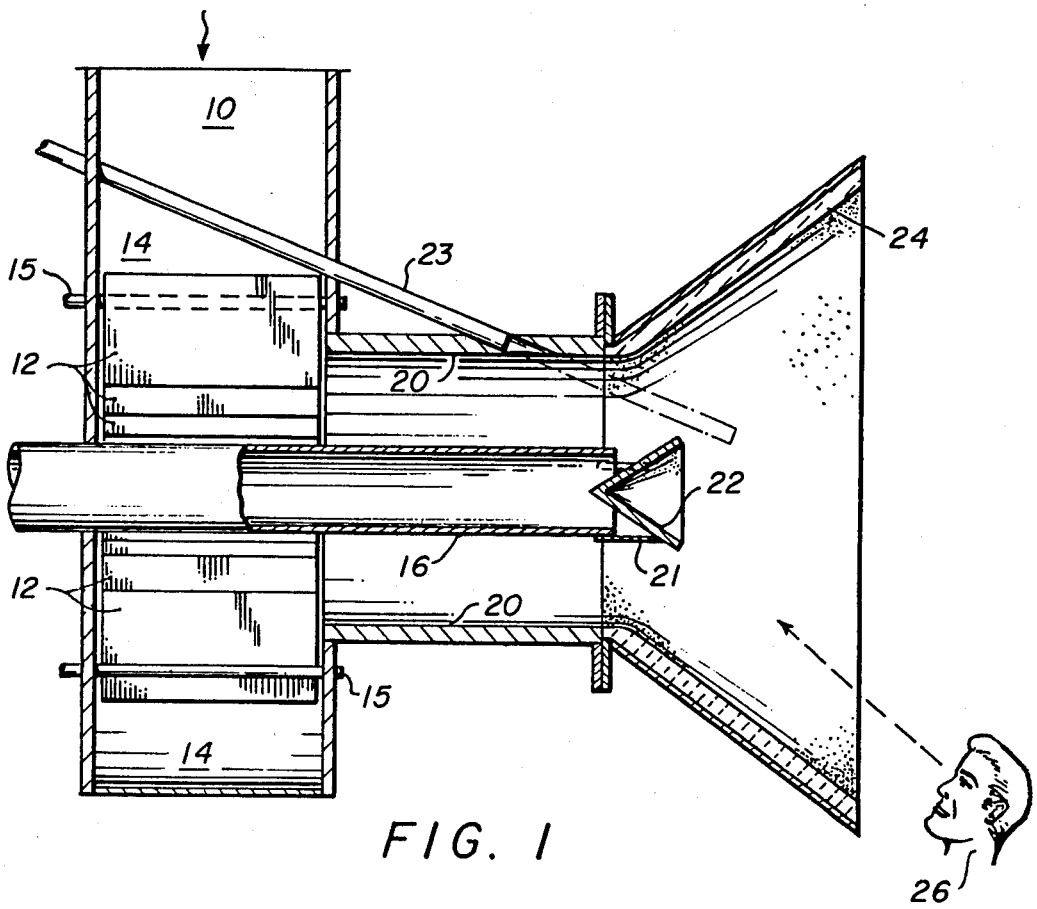
FIG. 1 is a cross-sectional view of an arc-ignited pulverized coal burner which may be employed in the practice of the present invention.

With reference to FIG. 1, a burner in accordance with a first embodiment of the present invention is shown. A coal pipe 16 is employed to convey coal pneumatically to the ignition zone in the burner. Accordingly, as the apparatus is shown in FIG. 1, the left end of coal pipe 16 is in communication with the coal feeder of FIGS. 2 and 3 while the right end of coal pipe 16 terminates at a hollow-cone diffuser which is mounted from coal pipe 16 by means of supports 21. An ignitor will be positioned immediately downstream of the discharge end of coal pipe 16. In the disclosed embodiment of the invention the ignitor, which is indicated at 23, enters through the side of the burner and comprises a high-energy arc ignitor similar to the type presently used for igniting oil. It is to be noted that any ignition source which permits sufficient energy to heat the reactants enough to ignite them may be used. Accordingly, a resistance heater or small pilot torch fueled by natural gas could be employed in place of the high energy arc ignitor. The high energy arc ignitor is, however, preferred because of its reliability and controllability. Ignitor 23, as shown in FIG. 1, will typically be retractably mounted so that it can be removed from the combustion zone into a protective area after the coal has been ignited.

The burner also includes a secondary air supply conduit 20 which is coaxial with coal pipe 16. Conduit 20 communuicates with an air chamber 14 which will typically be a cylindrical chamber somewhat larger in a diameter than that of conduit 20. Air chamber 14 contains a plurality of vanes 12. Vanes 12 are arranged to impart a swirl to air entering conduit 20 from chamber 14. An air inlet duct 10 leads to air chamber 14 from a pressurized air supply, not shown. Air conduit 20 terminates in a refractory-lined quarl 24 which defines a divergent nozzle. In one reduction to practice of the invention coal pipe 16 had a one inch inner diameter, conduit 20 had a six inch inner diameter and quarrel 24 had a thirteen inch diameter at its open end and an angle of divergence of 35°.

Figure 2:
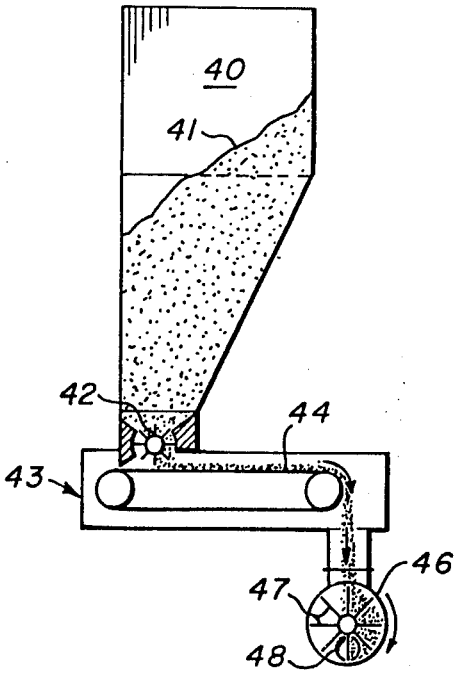
FIG. 2 is a cross-sectional view of a pulverized coal feed system which may be associated with the burner of FIG. 1.
Figure 3:
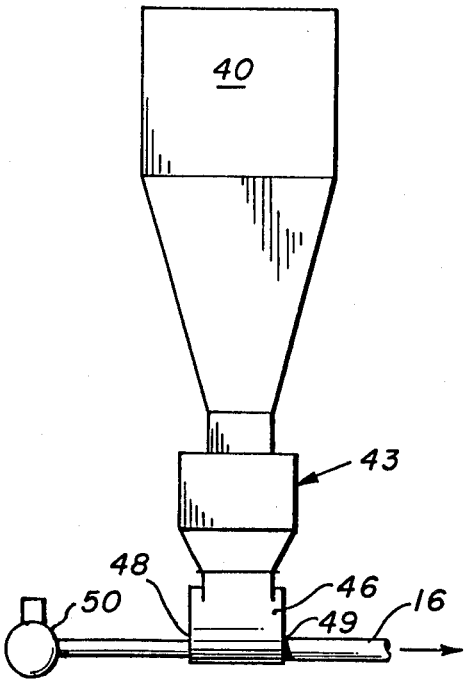
FIG. 3 is a front elevation view of the feeder system of FIG. 2.

FIGS. 2 and 3, which will be discussed simultaneously, show a pulverized-coal feed system for supplying a coal-air mixture to the coal pipe or fuel conduit 16. The feed system consists of a pulverized-coal hopper 40 that can be supplied by any of a number of means known in the art. Preferably, hopper 40 should be sized to store sufficient pulverized coal to supply the burner throughout the warm-up period of the furnace in which the burner is to be used. Hopper 40 communicates with gravimeteric feeder 43. Feeder 43 consists of a variable-speed feed device 42, a weight-sensitive conveyor 44 and appropriate control circuitry, not shown. The speed of rotation of variable-speed feeder 42 determines the amount of coal allowed to drop onto weight-sensitive conveyor 44, and the weight sensed by weight-sensitive conveyor 44 control the speed of this rotation. Gravimetric feeder 43 introduces coal into a rotary air-lock feeder 46 at a constant rate.

Rotary air-lock feeder 46 is a cylindrical chamber with blades 47 that approach an air-tight fit with the chamber. At the bottom of the chamber are entrance opening 48 and exit opening 49. The fit of blades 47 is such that there is almost no free air path between openings 48 or 49 and feeder 43. Accordingly, it is possible for an air stream entering opening 48 to continue out through opening 49 without being deflected into gravimetric feeder 43. The rotation of blades 47 carries pulverized coal dropped onto blades 47 by gravimetric feeder 43 into the air path between openings 48 and 49. Compressed air is supplied to feeder 46 by an appropriate source 50 at a controlled rate whereby a coal-air mixture having a predetermined air-to-coal weight ratio will be supplied through conduit 16 to the burner. According to the present invention, the coal-air mixture measured in conduit 16 has an air-to-coal weight ratio of 1.0 or less and preferably 0.5 or less.

In one reduction to practice of the invention, in which subbituminous C rank coal that had been pulverized to 70 percent minus 200 mesh was employed, the upper limit on air-to-coal weight ratio was 1.0. The optimum air-to-coal weight ratio will vary with coal type.

In order to operate the burner of FIG. 1, ignitor 23 is moved to its inserted position and turned on. Employing an arc ignitor, sparks produced by the ignitor having an energy content of approximately 25 joules, lasting about 10 microseconds each, and having a repetition rate of 10 Hertz have been succesfully employed. Compressor 50 is turned on once the ignitor has begun operation, and gravimetric feeder 43 is also started. The compressed air flowing through rotary-air-lock feeder 46 entrains measured amounts of pulverized coal and carries it through conduit 16 and hollow-cone diffuser 22. While it is possible to operate the burner of FIG. 1 without hollow-cone diffuser 22, it is considered desirable to include diffuser 22 in order to introduce a minor amount of recirculation during the ignition stage of operation. The coal-air mixture brought into the vicinity of ignitor 23 is ignited by the energy imparted by the ignitor and the resultant flame propagates through the coal. As a result, ignition occurs, and a relatively unsteady flame exists at the outlet of the burner. At this point, an observer 26 or an automatic flame-detection system determines that ignition has occurred and causes a secondary air flow through air inlet duct 10. Vanes 12 introduce a rotation into the air flow, and this results in a spiraling, or swirling, stream of air that flows down conduit 20 and through quarl 24. Quarl 24 is a divergent nozzle that enhances the recirculating effect that naturally occurs due to the vortical flow of air. The swirling stream of air envelops the combustion zone, and as a result the hot combustion products are drawn back into the region of fresh coal injection. The observable effect of this recirculation is that the flame becomes steady, and the stability of the flame is such that ignitor 23 can be turned off and withdrawn. Thus retracted, ignitor 23 remains in a protective area, thereby preventing damage to the ignitor due to the intense heat of combustion.

It is thought that the direct ignition of pulverized coal provided by present invention is successful because it provides appropriate conditions for propagation of flame within the flowing coal stream after the ignitor has caused ignition of some of the coal particles; above approximately a 1.0 air-to-coal weight ratio, propagation of the flame is difficult with unheated air, and direct ignition of pulverized coal by an arc ignitor accordingly does not work efficiently. On furnace startup, preheated air is not available and can be produced only through the expenditure of a significant quantity of energy and/or liquid or gaseous fuel. Combined with the provision of proper conditions for propagation of the flame is the provision of a recirculation zone that contributes to stability of the resultant coal flame. The recircultion causes hot products to be drawn back into the combustion zone, thereby causing the flame to provide its own ignition energy. Whatever the reasons for its success, however, the present invention does provide a means for satisfactory direct ignition of flowing pulverized coal.

The burner of FIG. 1 can be used as a warm-up burner for utility boilers. In utility-boiler operation, it is necessary for the boiler to be brought to an elevated temperature in order for its conventional coal burners to work properly. The burners of the present invention can be used to bring the furnace up to a temperature high enough for stable combustion in conventional burners. The present invention can also be used for both ignition and low-load stabilization.

Figure 4:
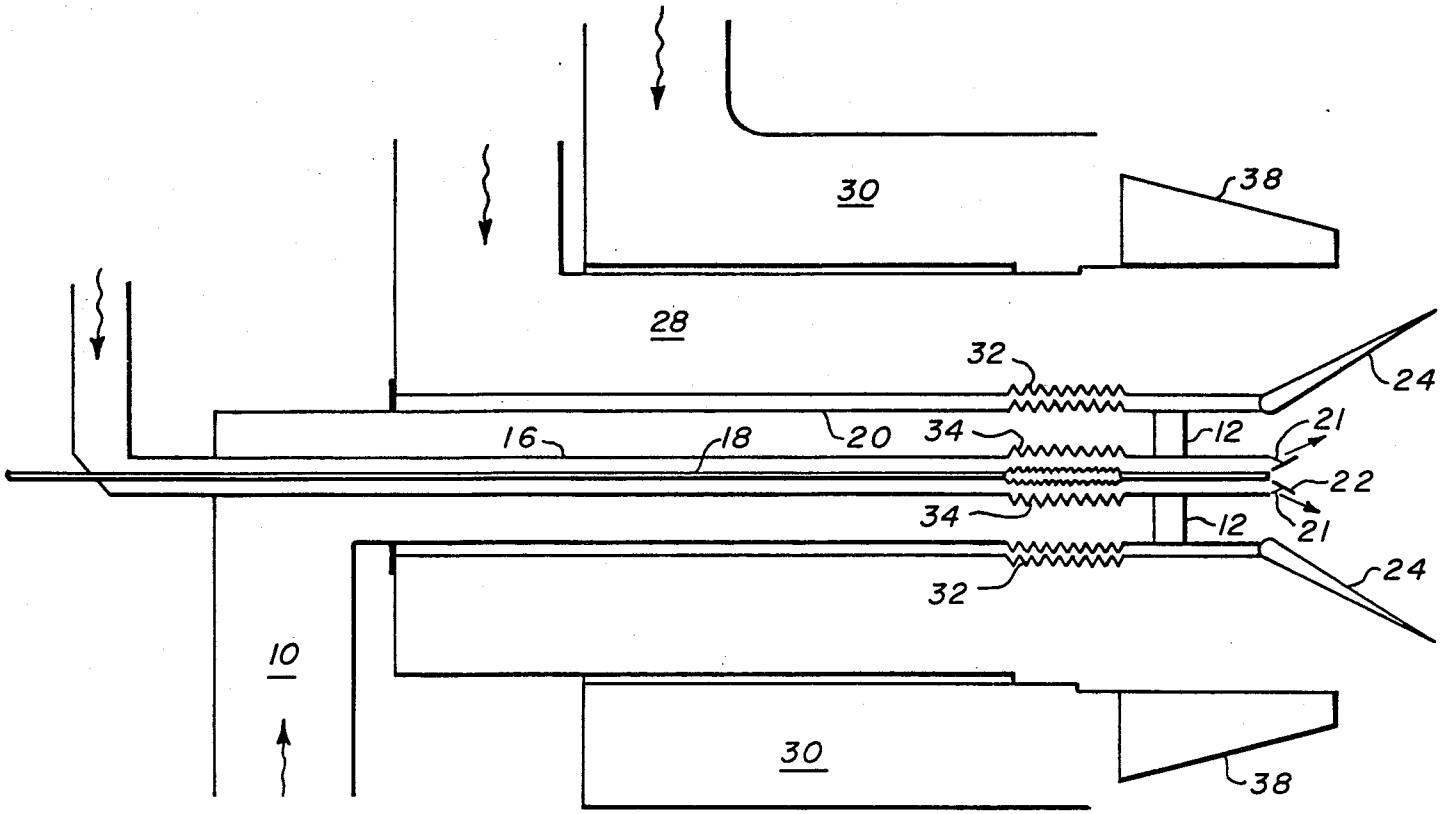
FIG. 4 is a cross-sectional view of a main coal burner which employs the burner of FIG. 1 as an igniter.

FIG. 4 is a side sectional view of a main coal nozzle. The center of the main coal nozzle is occupied by a version of the burner of FIG. 1 adapted to use as a center ignitor in a tilting tangential nozzle. Corresponding numbers refer to corresponding parts, most of which have already been explained in connection with FIG. 1. One difference is that quarrel 24 is shown to have a shape in FIG. 4 that is somewhat different from its shape in FIG. 1. Another difference is that vanes 12 are located within conduit 20 rather than in an air inlet duct.

A main coal pipe 28 is shown coaxial with the ignitor burner. Coal and primary air, the air used to dry and convey the pulverized coal, are supplied through main coal pipe 28. Secondary air, the remainder of the air required for combustion, is supplied through a conduit 30 that is concentric with main coal pipe 28. Vanes 38 are positioned at the outlet of conduit 30 and are arranged for tilting so that the air flowing out of conduit 30 may be directed as required. The tilting of vanes 38 would typically be accompanied by the tilting of the ignitor burner, so flexible sections 32, 34, 36 are included in the ignitor burner. In the typical arrangement, vanes 38 and the exit of the ignitor burner would be appropriately connected so as to tilt together.

In operation, the ignitor burner would be operated as previously explained, and after the ignitor had achieved stable combustion, coal and primary air would be sent to conduit 28, and secondary air would be sent to conduit 30. Ignition would occur due to the presence of the flame from the ignitor burner, and under low-load conditions the stabilization of the main flame would also be accomplished by the ignitor burner.

Several advantages are inherent in the apparatus of FIG. 4 and the method described in using it. In the typical coal nozzle used in a tangentially fired unit, the ignitor is mounted beside the main burner. The apparatus of FIG. 4 is an improvement over the typical arrangement because the center position affords greater proximity to the main coal stream, thereby allowing the use of a smaller amount of ignitor energy to produce the same effectiveness in igniting the main coal stream. Another advantage of the FIG. 4 arrangement is that the ignitor flame reaches the coal stream while it is still fuel rich. This is not tyically the case when side ignitors are used, and present theory suggests that oxides of nitrogen are less likely to be produced when a significant amount of combustion occurs in a fuel-rich zone. Test results with the present invention have verified that the center position of the ignitor is environmentally beneficial. A final advantage of the apparatus of FIG. 4 is that, since the ignitor uses coal exclusively, the fuel cost penalty for continuous use no longer exists. Thus, the additional complication of turning the ignitor off after ignition and turning it on again at low loads may be avoided. Furthermore, a single flame-proving device would be adequate, since it is only necessary, if the ignitor is intended to be used continuously, to insure that the ignitor flame is present. No additional flame-proving device need be provided to insure that the main flame is present.

Figure 5:
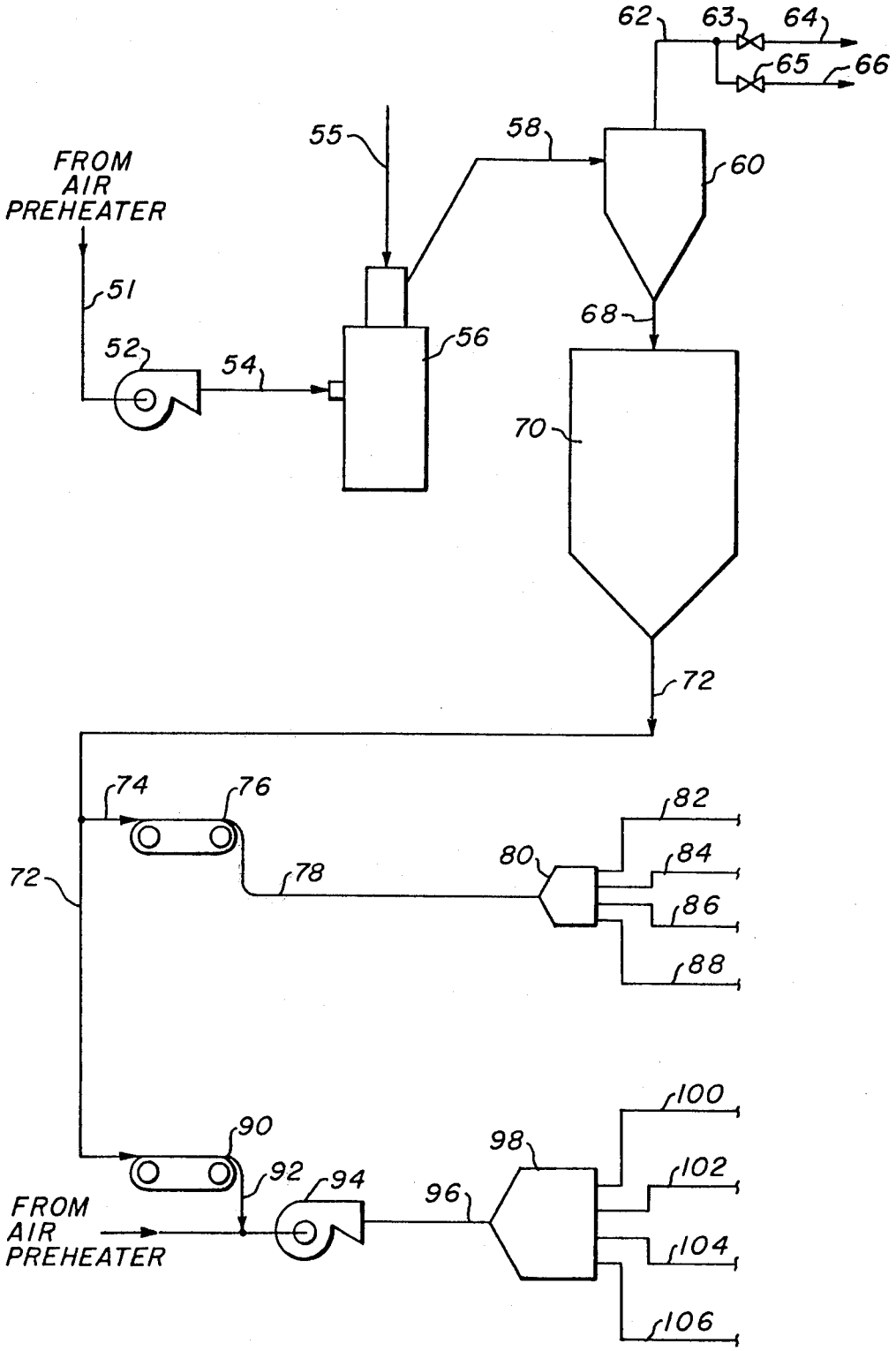
FIG. 5 is a diagramatic representation of a coal supply system for the igniter and burner of FIG. 4.

FIG. 5 schematically depicts a fuel supply system for the ignitor burner and main coal nozzle of FIG. 4. Pulverizer 56 is one of the types of coal mills known to the art. Its function is to grind coal for use in pulverized-coal units. It is typical for pulverizers to require hot air for the drying function that is usually carried out in conjunction with the grinding process. The hot air used for this function comes from an air preheater, not shown, that transfers heat from flue gases to air. The resulting hot air is drawn by mill fan 52 through line 51, and it is sent through line 54 to pulverizer 56. The hot air thus blown through the pulverizer dries the coal and entrains pulverized coal in order to convey it out of the pulverizer by way of line 58. Coal to be pulverized is supplied by means of coal line 55.

In a cold start-up, the air provided by the air preheater is not at the temperature normally desired for pulverizer operation. Accordingly, a fuel-storage silo is provided. This silo contains enough pulverized coal to supply all the ignitors in the furnace and one elevation of warm-up coal nozzles for as long as it takes to warm-up the furnace sufficiently to provide hot enough air for the air preheater for proper operation of the pulverizer. Silo 70 accordingly might have a capacity of around 800 tons of pulverized coal. A separator 60 is provided between pulverizer 56 and bin 70. The function of separator 60 is to separate out the air that has entrained the coal in pulverizer 56. The air leaves separator 60 through line 62, and the coal leaves separator 60 through line 68. Since the air leaving separator 60 is ordinarily not completely free of coal dust, it may not always be desirable to exhaust the separator directly into the boiler. Therefore, appropriate valving may be provided in order to filter the air output of the separator or to add the output of the separator to the main coal feed of the boiler. This is illustrated by lines 64 and 66 and valves 63 and 65. Line 64 might be a line to a filter, valve 63 being opened during initial start-up when the main coal feed to the boiler is not operating, and valve 65 might be open, allowing the air to flow through line 66 to the main coal feed when the main coal feed is operating.

Line 72 represents the communication of bin 70 with ignitors and warm-up nozzles. Line 72 may, for instance, be a screw conveyor that supplies coal to a feed system of the type that is illustrated in FIGS. 2 and 3. Alternately, bin 40 of FIGS. 2 and 3 could be embodied in bin 70 itself, with feeder 42 being one of several feeders supplied by the same bin. Feed system 76 supplies lines 82, 84, 86, and 88, the feed lines to the ignitors, by means of line 78 and a riffle distributor 80. Each of the lines 82, 84, 86, and 88 supplies a different level of ignitors. It may be determined that it is desirable to operate all ignitors whenever the furnace is operating, regardless of whether all elevations of coal nozzles are operating. In such a case, there would be no need to valve any of the lines 82, 84, 86, or 88. Alternately, it could be determined that only those ignitors would be operated that are associated with a coal nozzle that is to be operated. If this is the case, appropriate valving, not shown, would have to be supplied.

In addition to supplying the ignitors, bin 70 would also supply an elevation of warm-up nozzles. Each nozzle would be ignited and stabilized by one of the ignitors fed by line 88. A gravimetric feeder 90 supplied from bin 70 by means of line 72 would supply an exhauster 94, which would force coal and air from the air preheater through line 96 to riffle distributor 98. Riffle distributor 98 supplies each of the warm-up-nozzle lines 100, 102, 104, and 106. It would be typical for lines 100, 102, 104, and 106 to be operated together, because they are on the same elevation. In a typical cold start-up, bin 70 would have been filled with pulverized coal during a previous operation of the boiler. Of course, during the first start-up after the unit is built, it would be necessary to ship in enough pulverized coal to fill bin 70 or provide a temporary means of coal drying to allow pulverization. After the first operation of the boiler, however, the silo could always be kept filled by means of the prior operation of the boiler. Feed system 76 would start to operate, sending coal and air mixed according to the present invention to at least the ignitors supplied by line 88, which supplies the ignitors for the warm-up elevation. The ignitors would operate as previously indicated, and an igniting flame would be present at the center of each of the warm-up nozzles. As soon as flame has been proven, feeder 90 and exhauster 94 begin operation, conveying coal and air from bin 70 and the air preheater, respectively, to the warm-up nozzles, where the coal is ignited by the ignitors supplied by line 88. The boiler continues to be operated in this manner, pulverizer 56 and mill fan 52 remaining off, until the boiler has warmed up sufficiently to provide a high enough air temperature at the air-preheater exit. At this point, further elevations in the furnace would typically begin operation, with the ignitors at each elevation providing ignition and stabilization. Mill fan 52 and pulverizer 56 would also begin operation at this time, controlled by appropriate sensing devices that monitor the amount of coal stored by silo 70. Thus, the silo is replenished, and enough pulverized coal is stored to supply the next boiler start-up.

While preferred embodiments have been shown and described, various modifications and substitutions may be made thereto without departing from the spirit and scope of the invention. Accordingly, it will be understood that the present invention has been described by way of illustration and not limitation.

What is claimed is:

1. A method for reliably igniting pulverized coal in the absence of any other fuel and in the absence of sufficient inherent ignition energy to insure ignition comprising the steps of:

forming an ignitable mixture, the step of forming an ignitable mixture including:

providing a source of pulverized coal, the coal having a sufficiently small particle size such that the coal may undergo rapid thermal decomposition; and withdrawing the pulverized coal from the source and entraining the thus withdrawn coal in transport air to form a dense phase fuel stream having an air-to-coal weight ratio which is less than 0.5;

delivering the fuel stream to a combustion zone, there being insufficient ignition energy present in the combustion zone to insure ignition of the pulverized coal in the fuel stream;

discharging the fuel stream into the combustion zone in the form of a diverging stream having an axial region substantially comprised of air and relatively fine coal particles, the presence of coal particles in said axial region being caused by classification of the said particles resulting from recirculation of at least some of the coal generally in the upstream direction with respect to the axis of the fuel stream;

supplying a sufficient quantity of ignition energy to the coal in the axial region of the fuel stream to decompose the said coal particles and ignite the reactants in the coal;

causing the flame resulting from ignition of coal particles in the axial region of the fuel stream to propagate, the step of causing the flame to propagate including controlling the velocity of the fuel stream as a function of coal particle size and volatiles content;

verifying the presence of flame in the combustion zone; and stabilizing the flame by establishing a flow of secondary air in the combustion zone and generally coaxially with the fuel stream subsequent to verification of the presence of flame.

2. The method of claim 1 wherein the secondary air employed in the step of stabilizing the flame is initially at ambient temperature and wherein the volume of secondary air is controlled such that it contributes between 15% and 50% of the stoichiometric combustion air.

3. The method of claim 1 wherein the step of stabilizing the flame includes:

imparting a rotational movement to the flow of secondary air to cause a swirling air flow to envelop the fuel stream in the region of the supply of ignition energy thereto to thereby cause recirculation of combustion products in the general direction of the point of introduction of the fuel stream into the combustion zone.

4. The method of claim 1 further comprising:

terminating the supply of igniton energy to the combustion zone subsequent to verification of the presence of flame.

5. The method of claim 1 wherein the step of supplying ignition energy comprises:

establishing an intermittent electrical discharge.

6. The method of claim 1 wherein the step of causing the flame to propagate includes:

controlling the velocity of the fuel stream to cause it to be within the range of 60 to 150 feet per second at the time of discharge into the combustion zone.

7. The method of claim 1 further comprising the step of:

terminating the supply of ignition energy subsequent to establishing the flow of secondary air.

8. The method of claim 5 further comprising the steps of:

terminating the supply of ignition energy subsequent to establishing the flow of secondary air; and withdrawing the means for establishing an intermittent electrical discharge from the combustion zone upon termination of the supply of ignition energy.

9. The method of claim 2 wherein the ignition is for the purpose of starting an unheated furnace and wherein the step of stabilizing the flame includes:

imparting a rotational movement to the flow of secondary air to cause a swirling air flow to envelop the fuel stream in the region of the supply of ignition energy thereto to thereby cause recirculation of combustion products in the general direction of the point of introduction of the fuel stream into the combustion zone.

10. The method of claim 9 further comprising:

terminating the supply of ignition energy to the combustion zone subsequent to verification of the presence of flame.

11. The method of claim 9 wherein the step of supplying ignition energy comprises:

establishing an intermittent electrical discharge.

12. The method of claim 11 further comprising the steps of:

terminating the supply of ignition energy subsequent to establishing the flow of secondary air; and withdrawing the means for establishing an intermittent electrical discharge from the combustion zone upon termination of the supply of ignition energy.

13. The method of claim 9 wherein the step of causing the flame to propagate includes:

controlling the velocity of the fuel stream to cause it to be within the range of 60 to 150 feet per second at the time of discharge into the combustion zone.

14. The method of claim 13 wherein the step of supplying ignition energy comprises:

establishing an intermittent electrical discharge.

15. The method of claim 14 further comprising the steps of:

terminating the supply of ignition energy subsequent to establishing the flow of secondary air; and withdrawing the means for establishing an intermittent electrical discharge from the combustion zone upon termination of the supply of ignition energy.

16. The method of claim 13 further comprising:

terminating the supply of ignition energy to the combustion zone subsequent to verification of the presence of flame.

17. Apparatus for causing ignition and sustaining combustion of pulverized coal in a combustion zone in the absence of any supplementary fuel comprising:

means for forming an ignitable fuel-air mixture, said mixture forming means including a source of pulverized coal and means for entraining coal from said source in transport air to form a fuel stream having an air-to-coal weight ratio below approximately 0.5;

means for delivering the fuel stream from said forming means to a combustion zone;

classifier means in said combustion zone and cooperating with said delivering means for causing the fuel stream discharged into the combustion zone to be divergent with an axial region of relatively low velocity comprised of air and relatively fine coal particles;

means for intermittently supplying ignition energy to the combustion zone in said fuel stream axial region to cause decomposition of said relatively fine coal particles and ignition of the reactants in the coal;

means for selectively establishing a flow of secondary air in the combustion zone and generally coaxially of the fuel stream; and means for sensing the presence of flame in the combustion zone whereby the flow of secondary air may be delayed until subsequent to the sensing of flame.

18. The apparatus of claim 17 wherein said means for supplying ignition energy comprises:

an electric ignition energy source having a spark gap positioned in said combustion zone in said fuel stream axial region.

19. The apparatus of claim 17 wherein said means for establishing a coaxial flow of secondary air comprises:

a divergent nozzle positioned so as to encircle the fuel stream in the combustion zone; and means for causing air to flow through said divergent nozzle in order to cause a recirculating flow downstream of the nozzle to thereby direct hot combustion products back into the combustion zone.

20. The apparatus of claim 19 wherein said means for supplying ignition energy comprises:

an electric ignition energy source having a spark gap positioned in said combustion zone in said fuel stream axial region.

* * * * *